United States Patent [19]

Chollet et al.

[11] Patent Number: 4,916,786

[45] Date of Patent: Apr. 17, 1990

[54] METHOD OF ASSEMBLING AN ARMATURE OF AN UMBRELLA

[75] Inventors: Michel Chollet, Fontenay-sous-Bois; Pascal Bierling, Bry-sur-Marne; Christian Facoetti, Saint-Maurice, all of France

[73] Assignee: Interligne, Maisons-Alfort, France

[21] Appl. No.: 177,514

[22] Filed: Mar. 11, 1988

[30] Foreign Application Priority Data

Mar. 23, 1987 [FR] France ..... 87 03966

[51] Int. Cl.[4] ..... B21F 41/00

[52] U.S. Cl. ..... 29/25; 29/434; 135/20 R; 135/34

[58] Field of Search ..... 29/25, 434; 135/19.5, 135/20 R, 25 R, 34

[56] References Cited

U.S. PATENT DOCUMENTS

| | | | |
|---|---|---|---|
| 1,018,941 | 2/1912 | Storm | 135/20 R X |
| 1,051,698 | 1/1913 | Daggett | 135/34 X |
| 2,492,376 | 12/1949 | Brillas . | |
| 2,621,669 | 12/1952 | Mayer | 29/25 X |
| 3,177,883 | 4/1965 | Militano | 135/20 R |
| 3,446,221 | 5/1969 | Truitt . | |
| 3,564,679 | 2/1971 | Meyer | 29/25 |
| 4,061,154 | 12/1977 | Cox et al. | 135/34 |

FOREIGN PATENT DOCUMENTS

| | | |
|---|---|---|
| 1301023 | 8/1969 | Fed. Rep. of Germany . |
| 1342084 | 9/1963 | France . |

*Primary Examiner*—Timothy V. Eley
*Assistant Examiner*—Frances Chin
*Attorney, Agent, or Firm*—A. W. Breiner

[57] ABSTRACT

An armature of an umbrella, composed of elements (1) in the form of a monobloc casting, having several parts corresponding to the tension arm (2), the spokes (3) and a longitudinal portion (4) of the handle.

The different parts are connected to one another by joints formed from flexible tabs obtained during the casting. The ends of the spokes have means (18) for fastening the cloth, made by casting.

The ring is obtained from a planar casting having locking means at its ends.

5 Claims, 1 Drawing Sheet

METHOD OF ASSEMBLING AN ARMATURE OF AN UMBRELLA

The invention relates to an armature of an umbrella or similar, the said armature being formed by spokes and tension arms of which the ends are jointed on the one hand to the spokes and on the other hand to a ring sliding on the handle. The invention also relates to a method of assembling said umbrella or similar.

In a conventional umbrella, the armature is in general made up of an end ring, spokes, tension arms and a ring sliding on a handle.

The spokes are jointed at one of their ends to the end ring and are connected, approximately at their central part, by a joint, to one of the arm ends, the other end being jointed to the sliding ring. These different pieces are manufactured separately, and are assembled with the aid of rivet pins. In order to obtain sufficient rigidity and low weight, the long pieces of metal section are made having at the jointed points projecting lugs which are pierced to receive the pins. These pieces require at least one stamping/cutting operation and a folding operation, and some of them must furthermore undergo a piercing operation.

The assembly of the armature is composed of mounting and fastening the jointing and its covering, fastening the cloth to the free end of the spokes by stitching. These numerous operations entail high labor costs and do not ensure good reliability.

The object of the invention is to overcome these various disadvantages by providing an armature having a minimum of pieces, simple mounting and good reliability.

According to the invention, the armature is remarkable in that it is composed of elements formed from monobloc castings, composed of the tension arm, the spoke and a longitudinal portion of the handle, connected to one another by integral flexible junctions tabs, preferably formed directly during the casting of the element.

The explanations and figures, given below by way of example, will enable the implementation of the invention to be understood.

Figures 1, 2, 3, 4, 5, 6, 7:
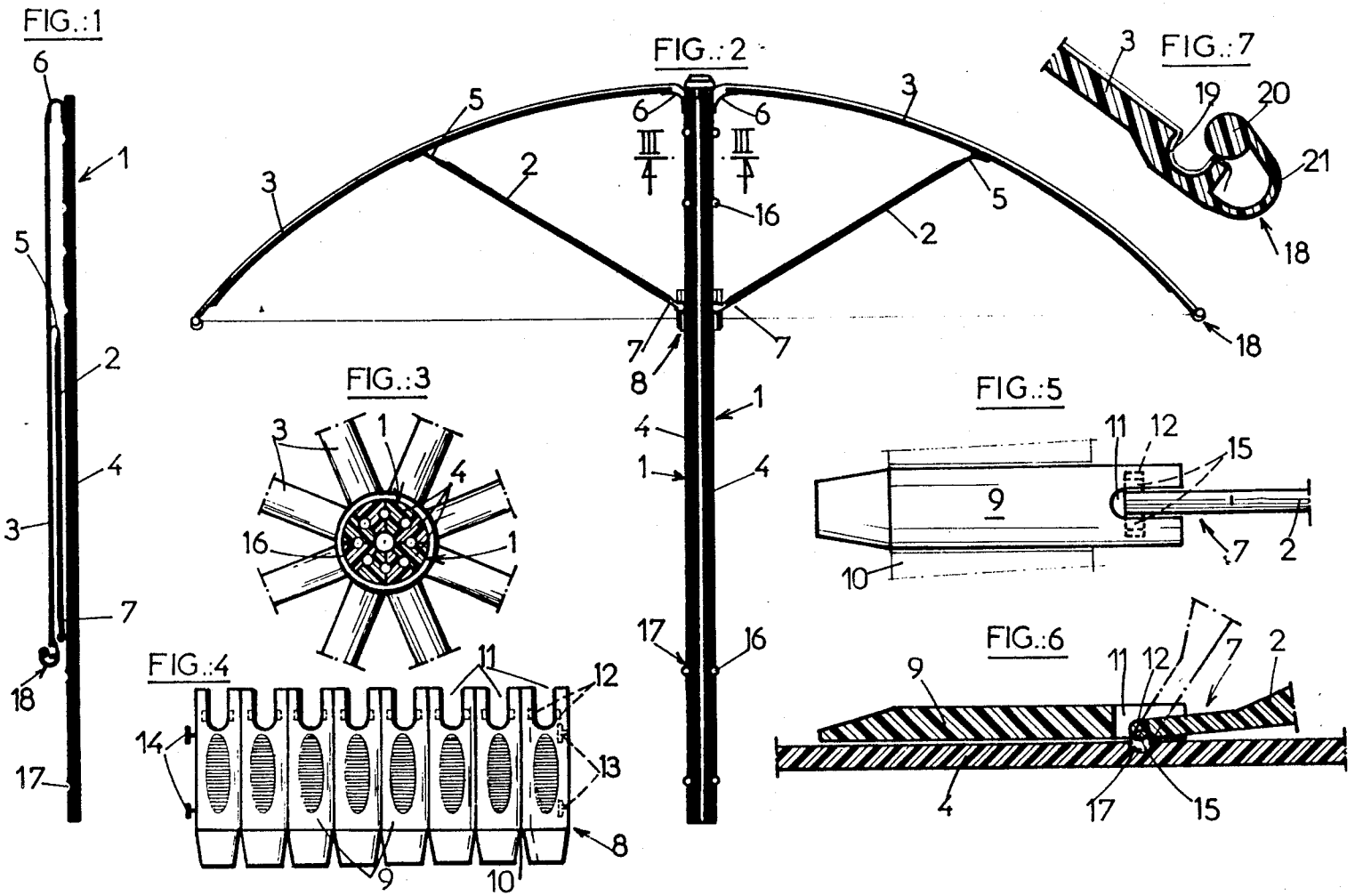
FIG. 1 is a side view of an armature element.
FIG. 2 is a longitudinal sectional view of an armature composed of elements according to the invention.
FIG. 3 is a partial view of a larger scale through III-III in FIG. 2.
FIG. 4 is a flat view of the sliding ring on a larger scale.
FIGS. 5 and 6 show a plan view of one of the elements forming the ring and a longitudinal sectional view of this same element.
FIG. 7 is an elevation view of a means of fastening the fabric provided at the end of a spoke.

According to one embodiment of the invention, the armature is composed of elements 1. Each element is in the form of a monobloc casting having several parts corresponding to a tension arm 2, a spoke 3 and a longitudinal portion 4 of the handle. These different parts are connected to one another by flexible jointed tabs 5 and 6, respectively provided between one end of the tension arm 2 and the spoke 3, in an approximately central zone, and between one end of the spoke and one end of the longitudinal portion 4 of the handle.

According to a preferred embodiment, these jointed tabs are obtained directly during the casting of the element 1.

Conventional umbrella have an armature having a maximum of eight spokes. The embodiment shown in FIGS. 2 and 3 has retained this value, and the armature shown is composed of eight elements 1.

In order to facilitate the mounting of the elements and, more particularly, of the handle portions 4, the latter have a substantially triangular or trapezoidal cross-section, enabling them to be assembled in a circle or a convex polygon.

In the example of FIG. 3, the handle portions have a section in the form of sectors of a circular ring.

The free ends 7 of the tension arms 2 are held in a ring 8, shown in its flat form in FIG. 4. This form corresponds to the flat casting which is then rolled to give a closed polygonal ring. The casting is composed of parallelepipedic elements 9 connected to one another by a connecting strip 10, made for example by narrowing the material separating the elements of the ring. The parallelepipedic elements 9, which are equal in number to the tension arms, have notches 11 on one of their small sides and along the longitudinal axis, the function of these notches being explained in detail later. Semi-cylindrical and coaxial receivers 12 are provided in the notches, on the sides opposite one another.

The longitudinal edges of the parallelepipedic end elements have complementary locking means 13, 14.

The free ends of the tension arms have stubs 15 (FIG. 5) which are capable of cooperating with the receives 12 of the ring elements in which they can turn freely. FIGS. 5 and 6 show one of the ring elements, in which there is held a tension arm 2.

The armature elements 1 are held in the assembled state by securely connecting the longitudinal handle portions, this secure connection being obtained by any known means, such as gluing, welding, hooping, etc.

According to the embodiment shown in FIG. 2, a means of hooping composed of elastic rings 16 lodged in circular grooves 17 provided in the handle portions 4 has been used.

They are provided at the free end of the spokes 3 means 18 of fastening the cloth, which, according to the embodiment shown are composed of a concave portion of elastic sockets 19, in which there is lodged a cylindrical convex body 20, which is connected to the end of the spoke by a flexible connection 21. The axis of the socket is approximately perpendicular to the plane of the spoke.

Preferably, the means for fastening the cloth are obtained directly during the casting of the armature element.

The fixing of the cloth is carried out by pinching between the socket portion and the cylindrical body.

According to embodiments which are not shown:

the armature is composed of three elements 1, representing an umbrella with three spokes, the arrangement of which can be selected according to the esthetic effect desired;

the arrangement of the armature elements will be determined by interspersing between the handle portions spacers which, in view of the simplification of the manufacture, will correspond to the handle portions of the armature elements;

the armature elements are cast in a semi-rigid material, and the thickness of the circular ring sectors of which the handle portions are composed is provided so that it can be deformed and held, by any known means, on a rigid core forming the center of the handle.

To simplify the description, an armature for an umbrella has been mentioned, but it is clear that any device having a folding armature supporting a sheet of supple material which can be folded is included in this term "umbrella".

The method of assembling an umbrella having the armature elements according to the invention resides in arranging the handle portions of the desired number of armature elements against one another so as to form a convex polygon or similar, and then in fastening the said portions to one another to form the handle; the ring is placed on the handle such that the stubs of the tension arms and the receivers of the ring cooperate, the ring is then closed by locking means, and the umbrella is finished by putting the cloth on the spokes and fastening it there by fastening means provided at the ends of the spokes.

According to a variant, spacers are interspersed between the handle portions.

According to another embodiment, the ring 8 is directly molded to its final shape with its inner bore being complementary to the transverse section of the handle. In this case, the ring 8 does not comprise said complementary locking means 13, 14 since the ring is one piece.

We claim:

1. An element for fabricating an armature of an umbrella, wherein said armature comprises a handle, a plurality of spokes joined to said handle, a ring slidably mounted on said handle and a plurality of tension arms each of which is joined to a respective spoke at one end and to said ring at the opposite end, said element being a unitary assembly comprising a spoke having a first and second end, a tension arm having a first and second end, a first flexible tab integrally molded with said spoke intermediate between said first and second spoke ends and said first end of said tension arm and constituting a hinge therebetween, coupling means integrally molded with said second end of said tension arm for pivotally interlocking said tension arm with a ring element, a longitudinal handle portion, and a second flexible tab integrally molded with said second end of said spoke and said longitudinal handle portion and constituting a hinge therebetween, said element being constructed and arranged whereby a plurality of said elements when mated together form an armature as defined.

2. An element as claimed in claim 1, wherein said first end of said spoke has a cloth fastening means formed as an integral part thereof, with said fastening means comprising a concave portion molded in the upper surface of said spoke and a convex body connected to said first end of said spoke by a flexible tie for snap engagement within said concave portion.

3. An element as claimed in claim 1, wherein the longitudinal handle portion has a substantially trapezoidal cross-section.

4. An element as claimed in claim 1, wherein the longitudinal handle portion has a section substantially in the form of a sector of a circular ring.

5. An armature of an umbrella comprising in combination of plurality of elements with each element being a unitary assembly comprising a spoke having a first and second end, a tension arm having a first and second end, first flexible tab integrally molded with said spoke intermediate between said first and second spoke ends and said first end of said tension arm and constituting a hinge therebetween, coupling means integrally molded with said second end of said tension arm for pivotally interlocking said tension arm with a ring element, a longitudinal handle portion, and a second flexible tab integrally molded with said second end of said spoke and said longitudinal handle portion and constituting a hinge therebetween, said plurality of elements being joined together by a ring means to form said armature.

* * * * *